US009598218B2

(12) United States Patent
Hallab

(10) Patent No.: US 9,598,218 B2
(45) Date of Patent: Mar. 21, 2017

(54) HEATED BIOLOGIC SHIPPING CONTAINER AND METHOD FOR TEMPERATURE MAINTENANCE OF BIOLOGIC SPECIMENS

(71) Applicant: ORTHOPEDIC ANALYSIS LLC, Chicago, IL (US)

(72) Inventor: Nadim J. Hallab, Oak Park, IL (US)

(73) Assignee: ORTHOPEDIC ANALYSIS LLC, Chicago, IL (US)

( * ) Notice: Subject to any disclaimer, the term of this patent is extended or adjusted under 35 U.S.C. 154(b) by 351 days.

(21) Appl. No.: 14/338,063

(22) Filed: Jul. 22, 2014

(65) Prior Publication Data

US 2016/0023833 A1 Jan. 28, 2016

(51) Int. Cl.

| | |
|---|---|
| ***B65D 81/02*** | (2006.01) |
| ***B65D 81/18*** | (2006.01) |
| ***B65D 81/38*** | (2006.01) |
| ***B01L 7/00*** | (2006.01) |
| ***B65D 77/04*** | (2006.01) |
| ***B65D 81/113*** | (2006.01) |
| ***B01L 7/04*** | (2010.01) |

(52) U.S. Cl.

CPC ..... *B65D 81/18* (2013.01); *B01L 7/00* (2013.01); *B01L 7/04* (2013.01); *B65D 77/048* (2013.01); *B65D 77/0426* (2013.01); *B65D 81/022* (2013.01); *B65D 81/113* (2013.01); *B65D 81/3825* (2013.01); *B65D 81/3841* (2013.01); *B01L 2200/185* (2013.01); *B01L 2300/0854* (2013.01); *B01L 2300/1827* (2013.01); *B01L 2300/1877* (2013.01); *B01L 2300/1894* (2013.01)

(58) Field of Classification Search

USPC ..... 126/263.01; 220/592.22

See application file for complete search history.

(56) References Cited

U.S. PATENT DOCUMENTS

| | | | | |
|---|---|---|---|---|
| 4,573,581 | A | 3/1986 | Galloway et al. | |
| 4,955,480 | A | 9/1990 | Sexton | |
| 5,236,088 | A | 8/1993 | Dhority et al. | |
| 5,419,152 | A | 5/1995 | Silber | |
| 5,924,302 | A * | 7/1999 | Derifield | B65D 81/3862 62/371 |

(Continued)

*Primary Examiner* — Avinash Savani

(74) *Attorney, Agent, or Firm* — Greer Burns & Crain, Ltd.

(57) ABSTRACT

A system for maintaining a biological sample within a desired temperature range during transport. Preferably, the system includes a container defining an inner chamber; a specimen receptacle for housing a biological sample, wherein the specimen receptacle is configured to be placed within the inner chamber of the container; a heat source configured to be placed within the inner chamber of the container; and a heat sink. The heat sink is configured to be positioned between the heat source and the specimen receptacle, thereby preventing direct heat transfer between the heart source and the specimen receptacle. Certain embodiments also relate to a method for maintaining biological samples within a desired temperature range during transport, using at least some of the system components. Preferably, the components used with the method are configured to maintain the sample at a temperature greater than 0° C. and less than approximately 37° C. during shipping.

21 Claims, 5 Drawing Sheets

(56) References Cited

U.S. PATENT DOCUMENTS

| | | | |
|---|---|---|---|
| 6,092,519 | A | 7/2000 | Fish et al. |
| 6,868,982 | B2 | 3/2005 | Gordon |
| 7,624,873 | B2 | 12/2009 | Tennant et al. |
| 8,669,240 | B2 | 3/2014 | Fischer et al. |
| 2003/0012701 | A1 | 1/2003 | Sangha et al. |
| 2014/0001188 | A1 | 1/2014 | Nahm et al. |

* cited by examiner

HEATED BIOLOGIC SHIPPING CONTAINER AND METHOD FOR TEMPERATURE MAINTENANCE OF BIOLOGIC SPECIMENS

BACKGROUND OF THE INVENTION

1. Field of the Invention

The present invention relates generally to insulated biologic specimen shipping containers and their associated components, and relates more specifically to those containers used to keep items within them warm, especially when being shipped during winter months to or from areas with colder climates. Where relevant, these containers and associated components, referred to as a system or kit, must comply with regulatory shipping requirements for biologic/diagnostic samples, and are employed when non-frozen tissues, such as blood etc., are shipped overnight in an attempt to conduct testing and analysis on viable living tissues or specimens.

2. Description of Related Art

Conventional insulated shipping containers that are typically used for shipping biologic/diagnostic samples employ foamed polymeric materials, such as polystyrene, which are used to provide one layer of insulation, and then this container is placed within a plastic bag and the combination is the placed within a cardboard box (or additional insulated container(s)) to maintain as much passive insulation as possible between the specimens and the surrounding environment. Such insulation materials are typically comprised of polyurethane or foamed polystyrene.

In addition to maintaining the specimen at the desired temperature, the shipment of diagnostic specimens must also conform to public safety standards, i.e. specific shipping regulations to protect the general public and all those who handle the container containing the biologic specimen during shipping. Any human diagnostic or biologic samples with the potential to be infectious or hazardous have to be shipped in compliance with specific packaging requirements for such materials. These standards are issued by the U.S. Postal Service (Domestic Mail Manual, DMM 601.10.17) in the United States, and by other similar authority on other countries. Thus, regardless of the requirements for viability, blood specimens and other biologic fluids or tissues for research or diagnostic laboratory testing are generally categorized as biologic diagnostic specimens, and the shipment of which must satisfy the postal packaging regulations in accordance with 49 C.F.R. §30 173.196, in the United States, or with the requirements of the relevant regulatory authority in other countries.

Previous packaging for such materials was typically in the form of pre-formed passive insulating package components, consisting by code of absorbent material, an insulating foam package, and an airtight plastic bag or pouch, all of which are placed inside a cardboard shipping container. These components lack an adequate way of maintaining sample temperature in cold weather shipping conditions for the duration of the shipping time. The passive insulation within these shipping containers typically included rigid foam components in attempts to provide the desired protection against temperature variation during shipment.

However, even when taken to the impractical extreme of placing several insulated containers within one another, such configurations involving passive foam insulation are insufficient, when environmental temperatures are below certain thresholds, to keep biologic samples from freezing, even over the course of expedited overnight shipping. Living cells within the tissues or fluids would freeze, or come close to freezing and lose viability, or specimen fidelity could be endangered to the point of becoming diagnostically or analytically compromised.

The maintenance of room temperature, or at least temperatures above freezing, over the course of shipping is critical for many human diagnostic tests where live immune cells are collected from blood tubes and their response to different conditions (e.g. antigens) is assayed or measured. Thus, there is a great need for an improved shipping container and method for keeping samples at near room temperature (or under non-freezing conditions) when shipping biologic specimens during the winter months. Biological samples that are shipped overnight during the winter months may freeze or reach temperatures near 0° C., at which point the cells lose viability (i.e., die). The present invention provides such a practical container system and method of winter temperature maintenance for shipping biologic specimens. The method and device will keep biologic specimens at biologically viable temperatures (40-98 degrees F. or 4.4° to 36.7° C.) when shipping overnight. The device will safely facilitate extended storage and transport of the samples at below ambient temperatures during winter months in situations when shipping blood samples, or other biological samples, overnight is not possible, but when viable living cells are required for diagnosis.

SUMMARY OF THE INVENTION

Briefly, a diagnostic shipping kit/method for keeping biological/diagnostic samples from freezing during shipping is provided. The shipping kit and methods include a heat source (such as a chemical or electrical heat source) combined with a heat sink within a container (such as a bottle or jar). Preferably, the container includes a vacuum between an inner and outer wall, such as that used to keep material, and especially liquids, either hot or cold for considerable periods (i.e. such as the insulated containers sold under the Thermos® brand). This container is configured to be shipped as is, or it can be placed inside one or more additional shipping materials (such as foam insulation), and/or a shipping box and/or a plastic pouch, in accordance with another aspect of the invention. This kit and method operates on the principle of chemical heat transfer from a controlled chemical heat source that is regulated and releases the over time by a heat sink (e.g. gel pack), or by an electronic heat source and battery that is then regulated by a sensor, in order to keep blood and other biologic samples at above freezing temperatures (with freezing temperature being <0° C. or <32° F.) when environmental shipping conditions are below 40° F. (4.4° C.). In the case of a chemical heat source, the kit and method both involve the use of both a heat source and a heat sink to effectively control the temperature over the course of shipping in cold weather. In the case of certain electronic heat sources, such as those of the type whose temperature can be controlled over time, the electronic heat source is electronically controlled to produce a stable temperature, thereby acting as both the heat source and the heat sink, in combination with the biologic/diagnostic samples and other contents provided within the container.

In particular, certain embodiments of the present invention relate to a system for maintaining one or more biological samples within a desired temperature range during transport. Preferably, the system includes a container defining an inner chamber; at least one specimen receptacle for housing a biological sample, wherein the specimen receptacle is configured to be placed within the inner chamber of the container; a heat source configured to be placed within the inner chamber of the container; and a heat sink configured to be placed within the inner chamber of the container. The heat sink is configured to be positioned between the heat source and the at least one specimen receptacle, thereby preventing direct heat transfer between the heart source and the at least one specimen receptacle.

Additionally, embodiments of the present invention also relate to a method for maintaining biological samples within a desired temperature range during transport. The method includes providing a heat source and a heat sink within a container; placing at least one vial containing a biological sample in the container such that the heat sink is positioned between the heat source and the at least one vial; and shipping the container from a first location to a second location in an environment where the ambient temperature is below approximately 4.4° C., at least temporarily. Further, the components are configured and arranged such that the sample within the at least one vial is maintained at a temperature greater than 0° C. and less than approximately 37° C. during the shipping.

BRIEF DESCRIPTION OF THE DRAWINGS

Preferred embodiments of the present invention are described herein with reference to the drawings wherein.

DETAILED DESCRIPTION OF THE PREFERRED EMBODIMENTS

Figure 1:
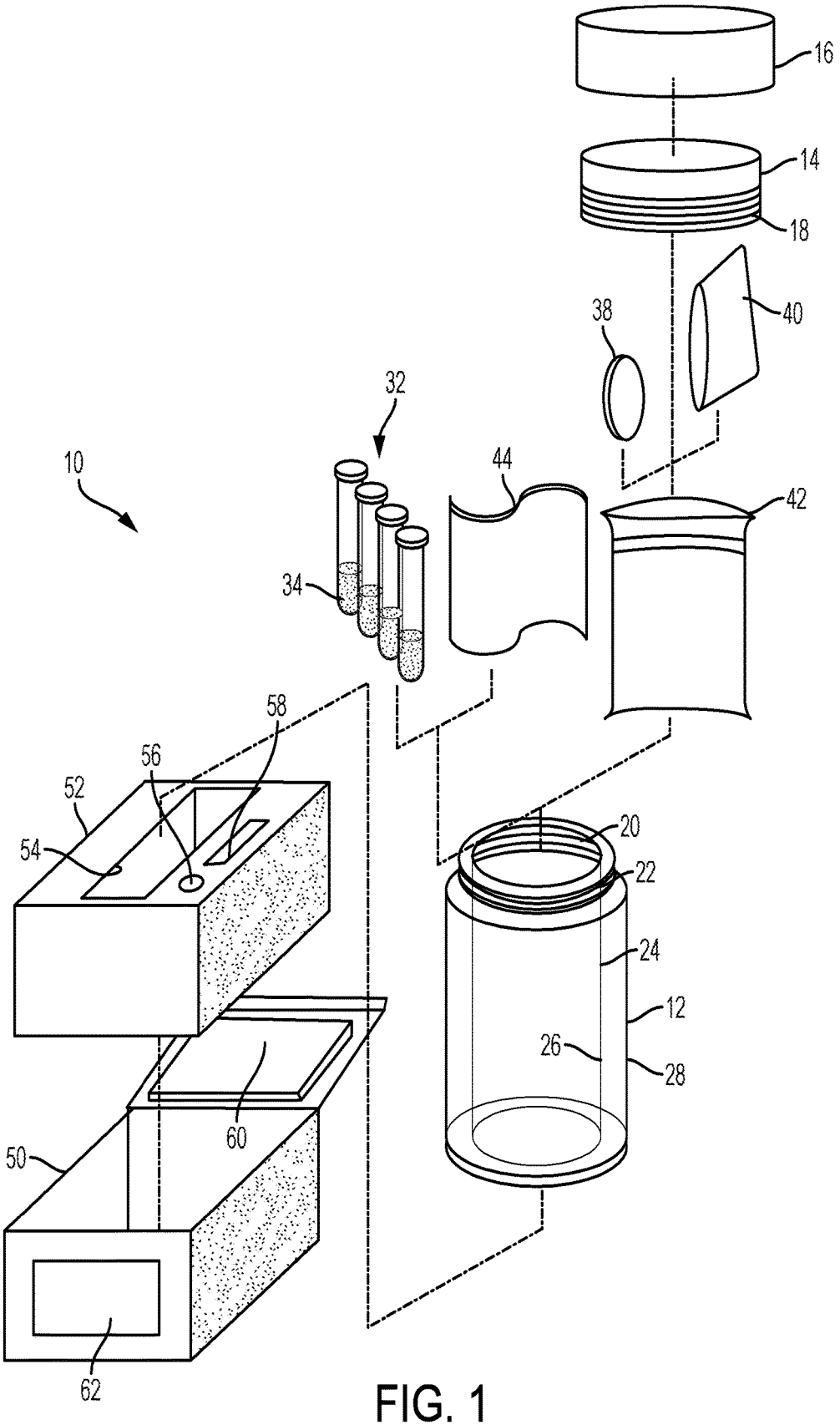
FIG. 1 is an exploded view of the components of one embodiment of a system of the present invention.
Figure 2:
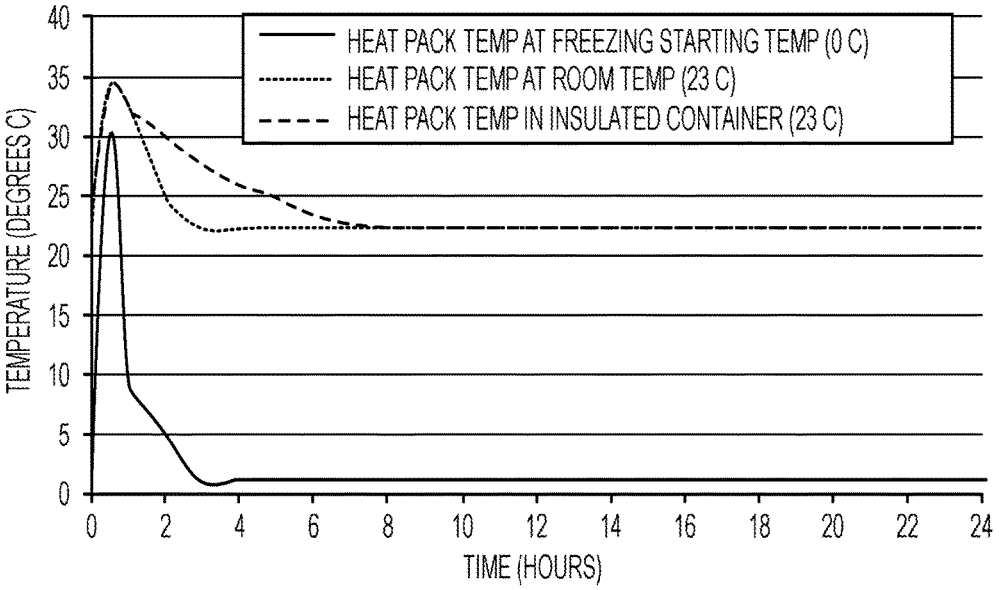
FIG. 2 is a graph showing temperature vs. time, based on actual measurements, of a chemical heat source taken under three different scenarios.
Figure 3:
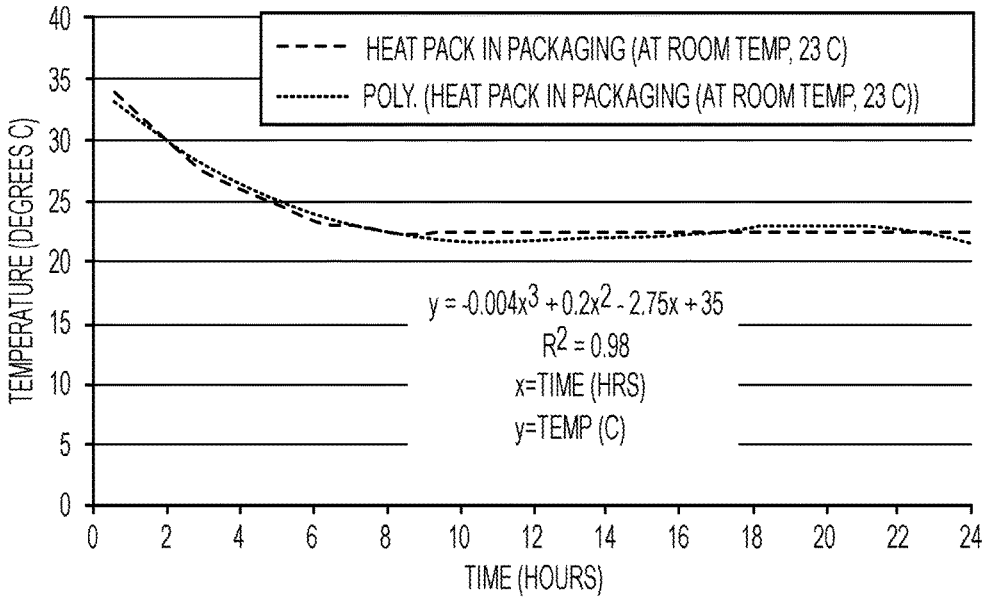
FIG. 3 is a temperature vs. time graph of one of the scenarios of FIG. 2, as well as a polynomial curve that has been fit to the data of that scenario.

Referring now to FIGS. 1-3, shown is an embodiment of the present system 10 for maintaining one or more biological samples within a desired temperature range during transport. The system 10 may alternatively be referred to as a kit. Such a kit is typically sent to a patient, or provided to a medical facility, with instructions on the procedures for collecting the biological samples; on the proper placement and assembly of the components of the system; and on how to ship the samples and kit to a testing facility (including indicating the testing facility address, where to designate the patient's name and date of birth on the container and/or outer packaging, etc.). The instruction sheet may also indicate the appropriate time of year for when such a kit (which could be referred to as a "winter testing kit") could be used. For example, the instructions could indicate that the "winter testing kit" is to be used between November and March, and that a different kit, such as a "non-winter testing kit" is to be used otherwise. The kit, including the biological sample(s), is then sent to the testing facility and the tests are conducted and the results are then reported back to the patient and/or the patient's physician.

One of the features of the present system is that it allows for overnight, or possibly even multi-day, shipment of biological samples, wherein a temperature of the biological sample is originally within a temperature range of approximately 30° C. to approximately 37° C., prior to be being housed within a specimen receptacle, and wherein the system is configured and arranged to maintain the biological sample at a desired temperature range of greater than approximately 4° C. to approximately 37° C. for at least twenty-four hours when the specimen receptacle, a heat source and a heat sink are positioned within a container, and the heat source is activated, even if the environmental temperature exterior of the container is below 0° C.

Referring now to FIG. 1, provided is a schematic representation of an exploded view of the components of one example of an embodiment of the present system 10. The system 10 includes a container 12 that is provided with some form of closure mechanism or removable cover portion, such as an inner cap 14 and an outer cap 16. As can be seen in FIG. 1, the inner cap 14 preferably includes a threaded portion 18 on an outer periphery thereof, and is configured for being received by complementary inner threaded portion 20 within the upper portion of the container 12. Outer cap 16 also preferably includes an internally threaded portion not shown) that is configured to mate with complementary outer threaded portion 22 on the upper portion of the container 12, whereby when in the closed/sealed condition, the outer cap 16 completely surrounds and covers the inner cap 14. Although a two part cap system (14 and 16) is shown and described, it is contemplated that other cap configurations could be employed, such as a single component configuration or other multi-component configurations, and that other closure means besides mating threaded portions, such as press-fit, snap-fit, etc., could be employed, as long as the desired secure closure of the container 12 is provided. Preferably, the capping mechanism includes insulating properties, and provides both an airtight and fluid-tight seal for the container 12.

In this preferred embodiment, the container 12 consists of a double-walled container including an interior layer 24 that defines an inner chamber 26, and an exterior layer 28 that surrounds the interior layer 24. The interior layer 24 and the exterior layer 28 may be made of any desired material, such as metal or plastic, and preferably a vacuum is defined between the interior layer and the exterior layer, thereby providing the desired insulation qualities. While such a configuration has been found to provide adequate insulation and fluid-tightness at an affordable price, other container configurations are also contemplated. Also, although the container 12 is shown as being generally cylindrical, other shaped containers are also contemplated.

FIG. 1 also shows examples of specimen receptacles 32, each configured for housing a biological sample 34. In the system 10, at least one specimen receptacle 32, such as a glass or plastic blood vial, is provided, and such receptacle(s) is (are) configured to be placed within the inner chamber 26 of the container 12. The biological sample 34 may be any type of sample intended to be tested, such as a blood sample or a biological tissue specimen. If desired, the specimen receptacles 32 may include a label (not shown) configured to include patient information (name, date of birth, etc.) or other identifying indicia (such as a code number related to the patient or type of biological testing to be conducted). Although four specimen receptacles 34 are shown in FIG. 1, it is contemplated that a single receptacle could be provided, or that more than four receptacles could also be provided, as long as the container 12 is sized appropriately.

One important component of the system 10 is a heat source 38 that is configured to be placed within the inner chamber 26 of the container 12. The heat source 38 may any desired type of heat source, such as a chemical heat source housed within a flexible pouch, where heat is generated by a chemical process triggered by a user; or an electrical heat source housed within a flexible pouch and where heat is generated by an electrical process triggered by a user. For example, if a chemical heat source is used, it may consist of a flexible pouch containing a supersaturated solution of sodium acetate in water in which a disk of notched ferrous metal is floating. The user presses the disk to release tiny adhered crystals of sodium acetate into the solution, which rapidly act as nucleation sites for the crystallization of the sodium acetate into the hydrated salt. The energy of the crystal lattice is released in the form of heat due to the sudden crystallization. In preferred embodiments, the temperature of the heat source does not exceed 45° C. at the time of shipping, and remains at a temperature above 4° C. for at least twenty-four hours, during winter shipping temperature conditions. If an electrochemical heat source is used it, could be configured to be activated by the user such that it maintains itself at a temperature between 45° C. and 5° C. for a period of twenty-four hours.

Figure 5:
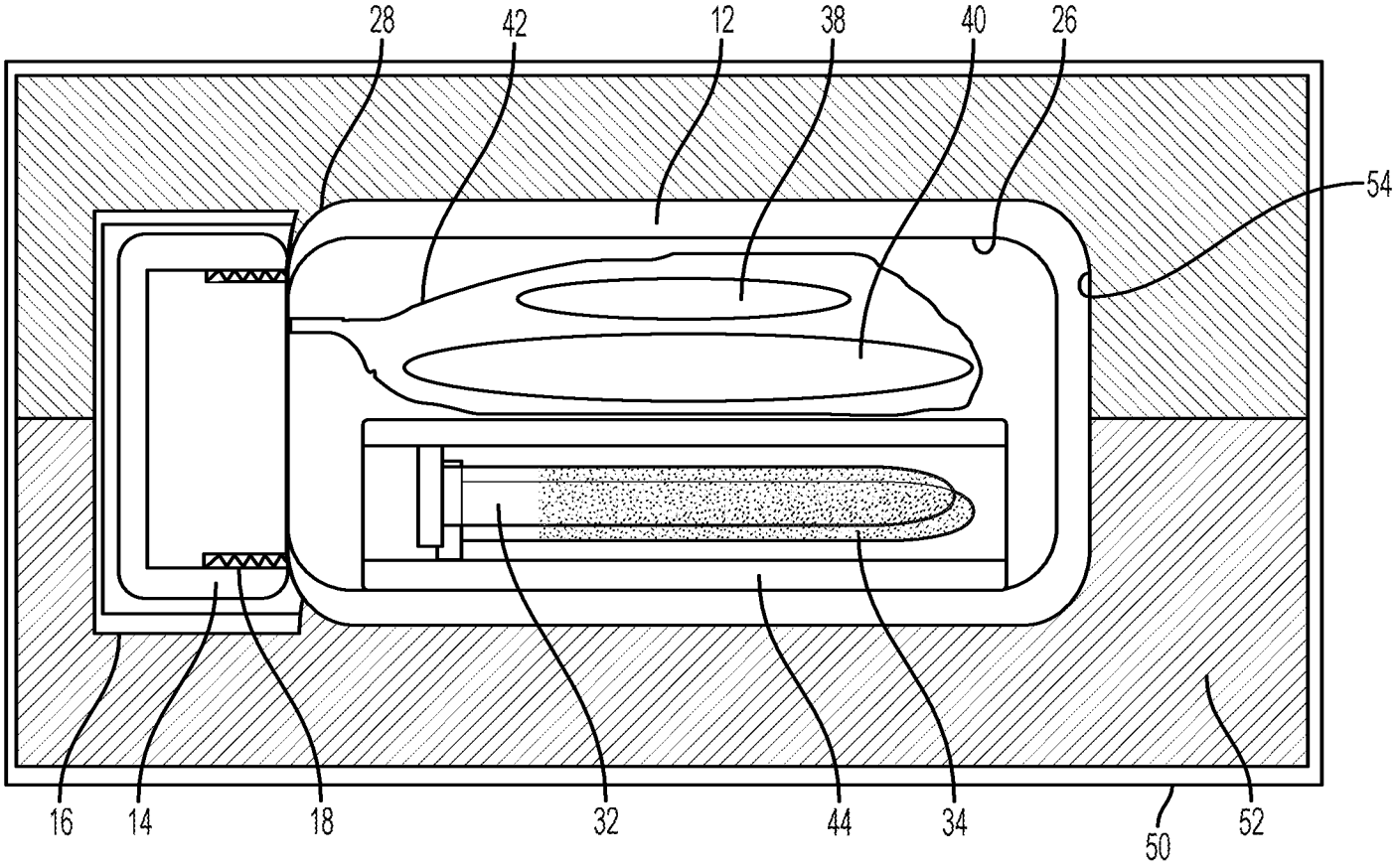
FIG. 5 is a cross-sectional view of the components of FIG. 1, shown with the component-filled container located within the shipping box.

FIG. 2 is a graph showing temperature vs. time, based on actual measurements taken under the following three different scenarios: (i) the solid dark line is based on measurements of a chemical heat source in ambient conditions of 0° C., where the heat source is not located within the container and is independent of the heat sink and the other components of the kit; (ii) the solid light line is based on measurements of a chemical heat source in ambient conditions of 23° C. (room temperature), where the heat source is not located within the container and is independent of the heat sink and the other components of the kit; and (iii) the broken line is based on measurements of a chemical heat source in ambient conditions of 23° C. (room temperature), with the heat source being positioned as shown in FIG. 5 (i.e., within the container, within in the box, and with all of the associated components of the entire kit in their proper locations). FIG. 3 is a graph showing scenario (iii) of FIG. 2 (i.e., the broken line of FIG. 2) as the heavier line, in which a polynomial curve, as a thinner line, has been fit to the line of scenario (iii). The equation of the curve is $y=0.0004x^3+0.2x^2-2.75x+35$, where x equals time (in hours) and y equals temperature (in ° C.).

As can be seen in the FIG. 2 graph, scenario (iii), with the broken line, shows how the temperature of the heat source decreases more slowly than scenario (i), with the dark solid line, and scenario (ii), with the light solid line, but even under scenario (iii), the heat source still ends up being equal to the ambient temperature well before the desired twenty-four hour shipping period. As explained below, a heat sink stores the heat from the heat source, and slowly dissipates that heat, thereby enabling the interior temperature of the container to be maintained within the desired temperature range for at least twenty-four hours.

Figure 4:
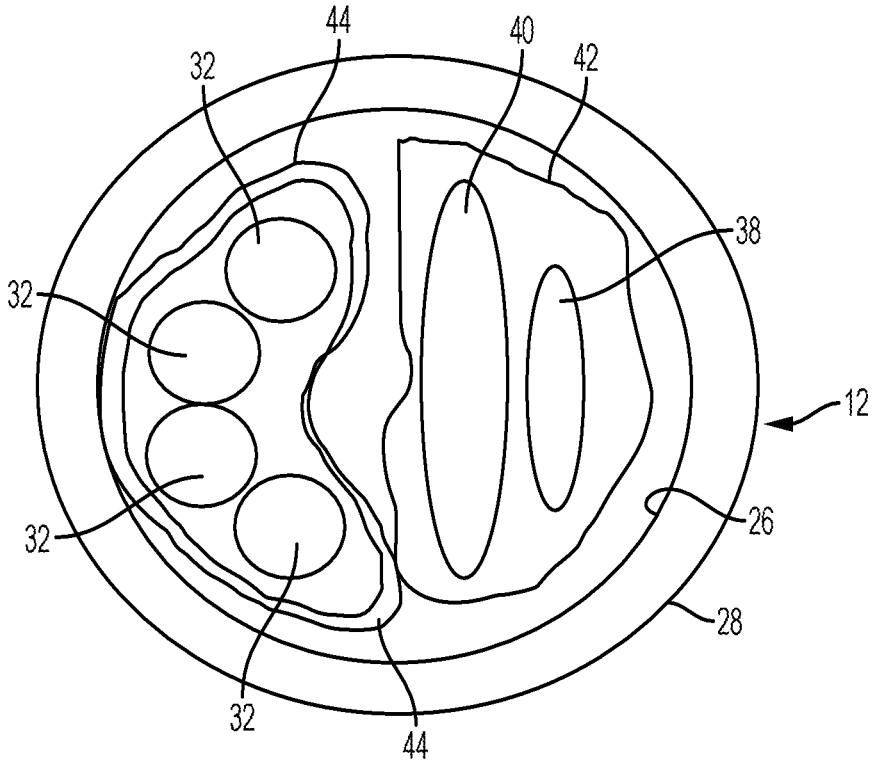
FIG. 4 is a top view of the container of FIG. 1, shown with the relevant components positioned therein.

Thus, another important component of the present system 10 is heat sink 40, which is configured to be placed within the inner chamber 26 of the container 12, at a location between the heat source 38 and the specimen receptacle(s) 32, thereby preventing direct heat transfer between the heart source 38 and the sample(s) 34 within the specimen receptacle(s) 32. FIGS. 4 and 5 show how the heat sink 40 separates the heat source 38 from the receptacles 32. One example of a heat sink 40 is a hot/cold gel pack comprised of a plastic package containing a mixture of water, propylene glycol, and triethanolamine, along with any optional preservatives and thickeners. If such a gel pack is used as the heart sink 40, it should not be heated or frozen before use (as such gel pack would otherwise typically be used), but instead should be provided at room temperature because such a gel pack is being used in the present system 10 as a heat sink, and not as a source of heat (or cold). More generally, the heat sink 40 could consist of a casing that houses a material selected from the group consisting of a polymeric matrix containing one or more thermal and chemical stabilizers and a degraded gel.

Figure 6:
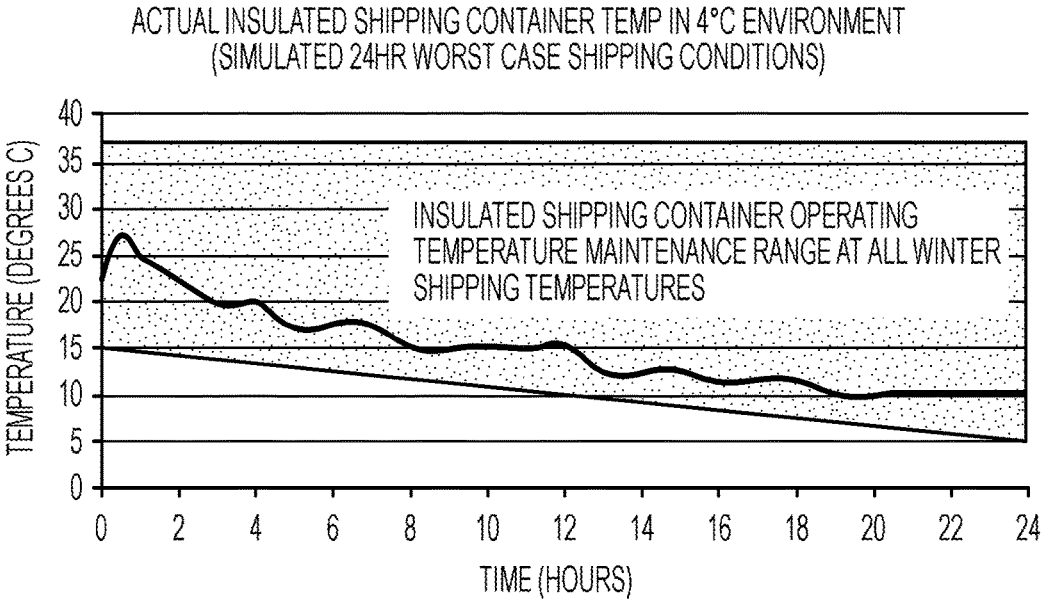
FIG. 6 is a temperature vs. time graph of the interior temperature of the container of one embodiment of the present system.

FIG. 6 is a graph showing temperature vs. time, based on actual measurements, where the temperature is the interior temperature of the container, with the heat source being positioned as shown in FIG. 5 (i.e., within the container, within in the box, and with all of the associated components of the entire kit in their proper locations), and with the kit being provided in a 4° C. environment, which is a simulation of the worst case shipping conditions. The shaded portion of FIG. 6 shows the acceptable temperature range for the twenty-four hour period. As can be seen from the line in FIG. 6, the addition of the heat sink, in combination with the other components of the kit, allows the interior temperature of the container to remain well within the desired range for the twenty-four hour period.

Other components of the system, which are optional and are shown in FIG. 1, include a plastic bag 42, or other suitable pouch-like member, and an absorbent material sheet 44, which is configured to be wrapped around the specimen receptacle(s) 34, as shown in FIGS. 4 and 5. The pouch-like member 42 is configured to contain the heat sink 40 and the heat source 32 in close proximity to each other when they are positioned within the inner chamber 26 of the container 12. Preferably, the heat sink 40 and the heat source 32 are maintained in direct contact with each other throughout the shipment, allowing for maximum effectiveness of both components. Such optional direct contact may also be provided by an elastic band, or other securing means. The absorbent material sheet 44 is provided to absorb any portions of the sample 34 that leak out of receptacle(s) 34, especially when such sample is a fluid, such as blood or urine. In certain embodiments, the absorbent sheet 44 consists of multiple layers of absorbent paper. Optionally, cloth towels or even paper towels could be used as the absorbent sheet 44.

Although the container 12 could be shipped as is (after applying appropriate mailed labels, postage, etc,), the system 10 preferably includes an outer box 50 (FIGS. 1 and 5) that is configured to receive the container 12 for more secure shipment. The outer box 50 may be made of any standard shipping material such as cardboard. Further, shock absorbing material is also preferably provided with the system 10, where the shock absorbing material in this embodiment is provided as member 52 (FIGS. 1 and 5) that is configured and arranged to maintain the container 12 out of contact with the outer box 50, thereby dampening forces applied to the outer box 50 in order to protect the container 12 from the forces.

The shock absorbing member 52 may consist of a pre-shaped member made of closed-cell extruded polystyrene foam (e.g., Styrofoam®), or other similar material, that is shaped to include a cavity 54 shaped to securely receive the container 12. Optionally, the shock absorbing member 52 may also include various cutouts, such as 56 and 58 of FIG. 1, that are sized to store various supplies that are used for the collection of the biological samples, such as needles, syringes, bandages, gauze, etc. As an alternative to shock absorbing member 52, other packing protection materials, such as bubble wrap, packing peanuts, etc., may be used if desired. Further, regardless of whether shock absorbing member 52 or an alternative shock absorbing means is used, a shock absorbing sheet 60 (FIG. 1) may optionally be provided in association with the lid portion of the outer box 50. Such a shock absorbing sheet 60 could be made of closed-cell extruded polystyrene foam (e.g., Styrofoam®), or other similar material. Also, the shock absorbing sheet 60 could be affixed to the lid portion of the portion of the outer box 50, or it could be loosely placed upon the container 12 (when positioned within the outer box 50) prior to closing and sealing the outer box 50. Finally, the outer box 50 could also include a mailing label 62, which includes the address of the testing facility, for example, as well as other information (such as for example, codes for the type(s) of testing being performed, codes or names of the patient; return address, etc.).

Now that examples of the components of the system 10 have been shown and described, an explanation of an embodiment of the method for maintaining biological samples within a desired temperature range during transport will be provided. In preferred embodiments, the system 10 is configured and arranged to maintain the desired temperature during shipping between a first location and a second location that extends for a duration of at least twenty four hours, even when environmental temperatures are below 5° C., at least temporarily. Preferably, the sample 34 within the at least one vial 32 is maintained at a temperature greater than 0° C. and less than approximately 37° C. during such shipping.

The biological samples 34 (such as blood, urine or tissue samples) are obtained in the customary manner, and are then inserted into the specimen receptacle(s) or vials 32. The specimen receptacle(s) 32 are then preferably wrapped within the absorbent material sheet 44, such that the sheet 44 substantially surrounds at the least the side surfaces of the receptacle(s) 32 (i.e., the top and bottom portions of the receptacle(s) need not be surrounded by the sheet 44), as can be seen in FIGS. 4 and 5.

At some point prior to putting the heat source 38 into the container 12, it should be activated to initiate the heat generation. In particular, the process includes a step of activating the heat source 38 such that heat is provided by the heat source 38 for at least a predetermined amount of time, such as for between zero and twenty-four hours at a temperature range of between 37° C. and 4° C. More specifically, when the heat source 38 is a chemical heat source housed within a flexible pouch, such heat is generated by a chemical process triggered by a user during such activating. On the other hand, when the heat source 38 is an electrical heat source, which may also be housed within a flexible pouch, such heat is generated by an electrical process triggered by a user during the activating.

Another step of the process is positioning the heat source 38, which has now been activated, adjacent the heat sink 40, and then placing both components into the container 12. Preferably, the process also includes a step of placing the heat source 38 and the heat sink 40 within a bag 42, such as a plastic bag, prior to the step of positioning the heat source and the heat sink within the container 12. FIGS. 4 and 5 show heat source 38 and heat sink 40 within bag 42. As an alternative to this optional step, the heat sink 40 and the heat source 38 may be maintained in close contact with each other in another way, such as by wrapping an elastic band around the two components. Alternatively, if the interior dimensions and shape of the inner chamber 26 are configured to maintain the heat sink 40 and the heat source 38 at the desired positions relative to each other and relative to the specimen receptacle(s) 32, the bag or elastic band may be omitted.

The next step relates to placing at least one vial 32 (or other specimen receptacle) containing the biological sample 34 into the inner chamber 26 of the container 12. During this step, care should be taken such that the heat sink 40 is positioned between the heat source 38 and the at least one vial 32, as can be seen in FIGS. 4 and 5. The heat source 38 should not be in direct contact with the vials 32, but should instead only indirectly provide heat to the samples 34 within the vials 32, because direct heat transfer to the samples 34 may cause overheating, resulting in damage to the samples, and thereby thwarting the desired testing.

If desired, or if necessary to comply with the relevant shipping regulations, a step of wrapping the absorbent material sheet 44 around the vial(s) 34 may be performed prior to the step of placing the vial(s) into the container 12. Such absorbent material sheet 44 provides additional insulation for the biological samples 34, and will also absorb any of the sample that accidently leaks from the vial(s) 34 during shipping.

Once all of the desired components are provided within the container 12, the container is sealed, such as via inner cap 14 and outer cap 16. If it is desired to ship the container 12 as is (i.e., without placing it in an outer box), the outer cap 16, or other closure means, may be further sealed, such as via packing tape, and a shipping label may be placed directly upon the outer surface of the container 12. As mentioned above, the shipping label may optionally include patient information and testing information, in addition to the address of the testing facility. The container 12 and the components therein can then be shipped to the testing facility, and the specimens can be tested.

On the other hand, if it is desired that the container 12 be further protected from shocks, it may shipped within an additional packing container, such as the outer box 50. If the use of the outer box 50 is desired, packing material, such the shock absorbing material 52, may be provided within the outer box 50, at a location between the container 12 and the outer box 50, as can be seen in FIG. 5.

As mentioned above, the shock absorbing material 52 preferably includes a cavity 54 that corresponds in shape to that of the shape of the outer periphery of the container 12. Accordingly, the container 12 (with the biological sample(s) 34 located within the specimen receptacle(s) 32, the heat source 38, the heat sink 40 and any other desired components appropriately positioned therein) can simply be seated within the cavity 54 of the shock absorbing material 52, which material 52 is already seated within the outer box 52. Then, a shipping label 62 may be placed upon the outer surface of the outer box 50. As mentioned above, the shipping label 62 may optionally include patient information and testing information, in addition to the address of the testing facility. The outer box 50 and the components therein can then be shipped to the testing facility, and the specimens can be tested.

As also mentioned above, when samples are shipped according to the method and with the components described herein, an internal temperature of more than 40 degrees F. (4.4° C.) can be maintained for over 24 hours while shipping in winter environmental conditions or at external temperatures of less than 32 degrees F. (0° C.).

The present container or shipping method is meant to be used only during the winter months or when the external shipping temperature is less than 40 degrees F. (4.4° C.).

Under conditions that are warmer than 40 degrees F. (4.4° C.), traditional passive foam insulation could be used.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A system for maintaining one or more biological samples within a desired temperature range during transport, the system comprising:

a container defining an inner chamber;

at least one specimen receptacle for housing a biological sample, wherein said specimen receptacle is configured to be placed within said inner chamber of said container;

a heat source configured to be placed within said inner chamber of said container, wherein said heat source is configured to increase, at least initially, the temperature within the container;

a heat sink configured to be placed within said inner chamber of said container, wherein said heat sink is configured to be positioned between said heat source and said at least one specimen receptacle, thereby preventing direct heat transfer between said heart source and said at least one specimen receptacle.

2. The system according to claim 1, wherein said container comprises an insulated, fluid tight container with a removable cover portion.

3. The system according to claim 1, wherein said container comprises a double-walled container including an interior layer that defines said inner chamber, and an exterior layer surrounding said interior layer, and further wherein a vacuum is defined between said interior layer and said exterior layer.

4. The system according to claim 1, wherein said one or more biological sample comprises a sample selected from the group consisting of a blood sample and a biological tissue specimen.

5. The system according to claim 1, wherein said heat source comprises a chemical heat source housed within a flexible pouch and where heat is generated by a chemical process triggered by a user.

6. The system according to claim 1, wherein said heat source comprises an electrical heat source housed within a flexible pouch and where heat is generated by an electrical process triggered by a user.

7. The system according to claim 1, wherein said heat sink comprises a casing that houses a material selected from the group consisting of a polymeric matrix containing one or more thermal and chemical stabilizers and a degraded gel.

8. The system according to claim 1, wherein a temperature of the biological sample is originally within a temperature range of approximately 30° C. to approximately 37° C., prior to be being housed within said specimen receptacle, and wherein the system is configured and arranged to maintain the biological sample at a desired temperature range of greater than approximately 4° C. to approximately 37° C. for at least twenty-four hours when said specimen receptacle, said heat source and said heat sink are positioned within said container, and said heat source is activated, even if the environmental temperature exterior of said container is below 0° C.

9. The system according to claim 1, further comprising:

an absorbent material sheet configured to be wrapped around said at least one specimen receptacle;

a plastic bag configured to contain said heat sink and said heat source when positioned within said inner chamber of said container; and an outer box configured to receive said container.

10. The system according to claim 9, wherein said absorbent sheet comprises a multiple layers of absorbent paper.

11. The system according to claim 9, further comprising shock absorbing material configured and arranged to maintain said container out of contact with said outer box, thereby dampening forces applied to said outer box in order to protect said container from the forces.

12. A method for maintaining biological samples within a desired temperature range during transport, the method comprising:

providing a heat source, whose temperature increases after activation, and a heat sink within a container;

placing at least one vial containing a biological sample in the container such that the heat sink is positioned between the heat source and the at least one vial; and shipping the container from a first location to a second location in an environment where the ambient temperature is below approximately 5° C., at least temporarily, whereby the sample within the at least one vial is maintained at a temperature greater than 0° C. and less than approximately 37° C. during said shipping.

13. The method according to claim 12, wherein said shipping between the first location and the second location extends for a duration of at least twenty four hours.

14. The method according to claim 12, further comprising a step of activating the heat source such that heat is provided by said heat source for at least a predetermined amount of time.

15. The method according to claim 14, wherein said heat source comprises a chemical heat source housed within a flexible pouch and where heat is generated by a chemical process triggered by a user during said activating.

16. The method according to claim 14, wherein said heat source comprises an electrical heat source housed within a flexible pouch and where heat is generated by an electrical process triggered by a user during said activating.

17. The method according to claim 12, further comprising:

placing the heat source and the heat sink within a plastic bag prior to the step of positioning the heat source and the heat sink within the container;

wrapping an absorbent material sheet around said at least one vial prior to the step of placing said at least one vial in the container; and placing the container within an outer box, prior to the step of shipping.

18. The method according to claim 17, further comprising providing shock absorbing material within the outer box, between the container and the outer box.

19. A system for maintaining one or more biological samples within a desired temperature range during transport, the system comprising:

a container defining an inner chamber;

at least one specimen receptacle for housing a biological sample, wherein said specimen receptacle is configured to be placed within said inner chamber of said container;

a heat source configured to be placed within said inner chamber of said container;

a heat sink configured to be placed within said inner chamber of said container, wherein said heat sink is configured to be positioned between said heat source and said at least one specimen receptacle, thereby preventing direct heat transfer between said heart source and said at least one specimen receptacle, wherein said heat source comprises a heat source selected from one of the following:

a chemical heat source where heat is generated by a chemical process triggered by a user, and an electrical heat source where heat is generated by an electrical process triggered by a user.

20. The system according to claim 19, wherein:

said container comprises a double-walled container including an interior layer that defines said inner chamber, and an exterior layer surrounding said interior layer, and further wherein a vacuum is defined between said interior layer and said exterior layer; and said one or more biological sample comprises a sample selected from the group consisting of a blood sample and a biological tissue specimen.

21. The system according to claim 20, wherein a temperature of the biological sample is originally within a temperature range of approximately 30° C. to approximately 37° C., prior to be being housed within said specimen receptacle, and wherein the system is configured and arranged to maintain the biological sample at a desired temperature range of greater than approximately 4° C. to approximately 37° C. for at least twenty-four hours when said specimen receptacle, said heat source and said heat sink are positioned within said container, and said heat source is activated, even if the environmental temperature exterior of said container is below 0° C.

* * * * *